United States Patent [19]

Kuettner

[11] Patent Number: 4,565,594

[45] Date of Patent: Jan. 21, 1986

[54] LOW NOISE CABLE CONSTRUCTION

[75] Inventor: Horst Kuettner, Huntington, N.Y.

[73] Assignee: Thermax Wire Corporation, Flushing, N.Y.

[21] Appl. No.: 546,566

[22] Filed: Oct. 28, 1983

[51] Int. Cl.[4] ..... H01B 13/00

[52] U.S. Cl. ..... 156/47; 174/102 R

[58] Field of Search ..... 174/102 R, 110 FC; 156/47, 50, 273.9, 275.5; 264/346

[56] References Cited

U.S. PATENT DOCUMENTS

| | | | |
|---|---|---|---|
| 3,433,687 | 3/1969 | Price | 174/102 SC |
| 3,670,058 | 6/1972 | Burney | 174/102 R X |
| 4,229,238 | 10/1980 | Saito | 264/346 X |
| 4,425,374 | 1/1984 | McCutcheon, Sr. | 264/346 |

FOREIGN PATENT DOCUMENTS

| | | | |
|---|---|---|---|
| 47668 | 12/1974 | Japan | 174/110 FC |
| 11315 | 4/1976 | Japan | 174/110 FC |

OTHER PUBLICATIONS

Kao, et al.; Kinetics of Solidification of Cross-Linked Polyethylene; 1982 Annual Report of the Conference on Electrical Insulation and Dielectric Phenomena; IEEE; 1982.

Inuishi, Y.; Effect of Space Charge and Structure of Breakdown of Liquids and Solids 1982 Annual Report of the Conference on Electrical Insulation and Dielectric Phenomena; IEEE; 1982.

Gross, et al.; High Temperature Conductivity of Dielectrics 1982 Annual Report of the Conference on Electrical Insulation and Dielectric Phenomena; IEEE; 1982.

Kaneko, F.; A New Measurement of Ionic Mobility in Insulators by Thermally Stimulated Currents 1982 Annual Report of the Conference on Electrical Insulation and Dielectric Phenomena; IEEE; 1982.

Plans, et al.; The Effect of Charged Centers in Thermally Stimulated Currents; 1982 Annual Report of the Conference on Electrical Insulation and Dielectric Phenomena; IEEE; 1982.

*Primary Examiner*—A. C. Prescott

*Assistant Examiner*—Morris H. Nimmo

*Attorney, Agent, or Firm*—Charles E. Temko

[57] ABSTRACT

An improved method of conditioning coaxial and other multiconductor cable to provide low levels of noise caused by piezo and pyro-induced effects, which includes the steps of shorting the inner conductors to the outer braided cover, while maintaining the cable at an elevated temperature below the melting point of the dielectric material and above any transition points for a period of time sufficient to complete molecular rearrangement of the dielectric material disclosed between the conductors and cover.

1 Claim, 1 Drawing Figure

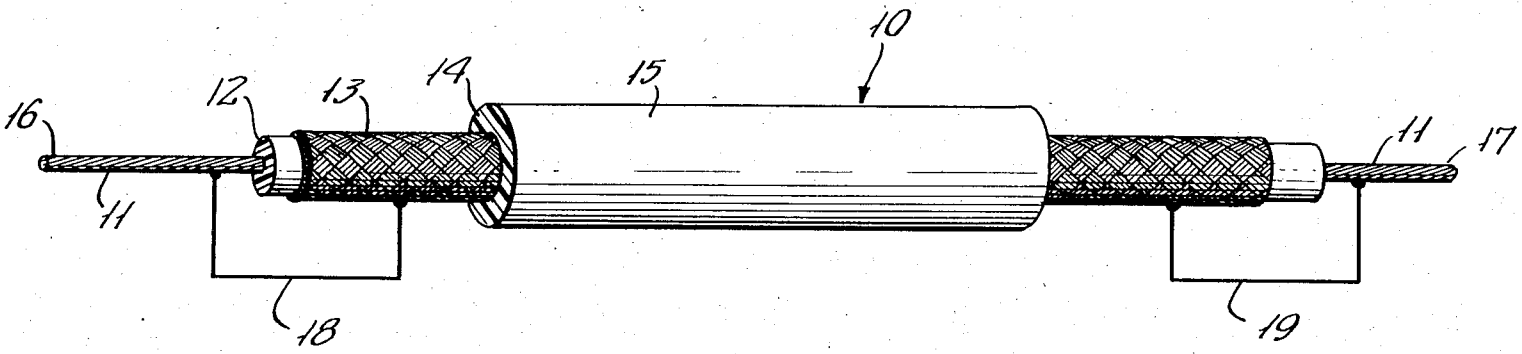
10
11
12
13
14
15
16
17
18
19

LOW NOISE CABLE CONSTRUCTION

BACKGROUND OF THE INVENTION

This invention relates generally to the field of electrically conductive wires and cables, and more particularly to an improved low noise cable suitable for use in communications and signal transmission.

So called low noise cables of known type are characterized in the provision of a semi-conducting layer applied over the dielectric or insulative material which encloses the metal conductor or conductors. With such construction, there has been a significant reduction in piezo induced, that is to say mechanically generated, noise. The use of such cables, however, is not ideal, as there has been considerable need for improvement, particularly when the cables are used in conjunction with solid state equipment which requires very low voltage and amperage levels during operation. Further, a basic problem, that of pyro generated noise has not been resolved in such cables, as compared with conventional cables.

The Burney U.S. Pat. No. 3,670,058 of June 13, 1972, describes an early attempt at solving the problem, in the provision of a method of reducing or minimizing noise in co-axial cable including the steps of heating the cable sufficiently to soften the dielectric filler, applying an alternating voltage across the inner and outer conductors of the cable, and cooling the cable while maintaining the voltage across it. This has resulted in substantial reduction of noise, but not a total elimination of residual current.

SUMMARY OF THE INVENTION

Briefly stated, the invention contemplates the provision of an improved low noise cable construction in which mechanically generated noise has been reduced by several orders of magnitude, as compared with prior art constructions. Pyro induced current is also reduced as well. To achieve this result, the dielectric covering the cable is heat treated during manufacture to change the crystalline structure of the material to amorphous state while simultaneously maintaining zero potential on the material during such treatment. This is accomplished by heat treating the manufactured cable and shorting the conductor and the braided metal sheath as the cable is heated over a relatively long period of time at elevated temperatures, and slowly cooled to room temperature.

Another aspect of the invention is the reduction of piezo and pyro electric effects in the dielectric material by minimizing ionization in the material by preventing photo injection or electron-ion injection by adequate shielding of the dielectric through external means, such as the application of a polymeric jacket with energy absorbing characteristics, or, in the case of gamma radiation, the use of higher density materials, such as lead, the object being to prevent any ionization and formation of loose electrons in the underlying dielectric material.

I have found that by shorting the cable while in heated state, as compared to subjecting the cable to an alternating voltage, a superior degree of elimination of residual currents is obtained.

In the drawing, the single FIGURE is a schematic view in prospective showing the treatment of a coaxial cable in accordance with the invention.

DETAILED DESCRIPTION OF THE DISCLOSED EMBODIMENT

Before entering into a detailed description of the structural aspects of the disclosed embodiments, a brief description of the theory involved is considered apposite.

The electrical performance of dielectric materials has been extensively studied. A variety of such dielectrics have the ability to retain electrically or radiation induced change, even when the source of the change has been removed. Plastic deformation gives rise to a similar space charge effect due to defects introduced by dislocation movement in the polymer. Space charge and phase transition provide predominant secondary factors to substantially modify the intrinsic breakdown, in piezo as well as pyro electric behavior in both solid and liquid dielectrics. The factors are closely related to the molecular structure, morphology and defects in the dielectric materials. This phenomenon is assisted by photo or ionization mechanisms, through the introduction of excess carriers through photogeneration, electron ion or photo injection. Above the glass transition, the space charges disappear due to the micro space Brownian movement in the amorphous phase.

At elevated temperatures, the predominant carrier species are considered to be ions, the free volume of which is closely related to the free volume of the polymers, the species being affected by transitions in the materials, and large scale backbone motions of the main molecular chains of the polymer.

The total charge involved in in the dielectric can be varied by a field that is externally applied, thus, freezing the photogeneration process. Specifically, the polarization can be frozen by cooling a sample which when heated will produce a thermally stimulated current due to ionic space charge polarization. If the sample is short circuited during the heating period, all of the charge is dissipated, and if the sample is then slowly cooled or annealed, it becomes resistant to both piezo and thermally stimulated current thereafter.

Referring now to the drawing, reference character 10 designates a typical coaxial conductor ready for treatment after fabrication. The cable includes a central conductor 11, a first layer of insulation 12, a second conductor 13, usually of braided type and a second layer of insulation 14 which is bounded by an outer surface 15.

The cable 10 may be of any desired finite length, and will include first and second ends 16 and 17. Short lengths of wire 18 and 19 are temporarily soldered or otherwise affixed to interconnect the first and second conductors 11 and 13, thereby effectively shorting them. The layers 12 and 14 are preferably of polytetrafluoroethylene.

Thus, following manufacture of a low noise cable embodying the invention, the completed cable is first shorted through the external shield and the centrally disposed conductor, following which it is heated above any transition points where molecular rearrangement will occur, including, but not limited to, the glass transition and melting points. By maintaining the sample at elevated temperature for an extended time period, typically twenty-four hours, and then gradually reducing the grounded specimen to room temperature, the propensity to exhibit piezo electricity or pyro electricity is significantly reduced.

Using a test length of seven hundred fifty feet of coaxial cable with each end exposed in free air and the conductor and outer shield tied together so as to make a complete short in the cable, the same was placed into a Blue-M air circulating oven at a temperature of 230° C. with a shifting air velocity of 300 cubic feet per minute for a period of twenty-four hours. After this conditioning period, the cable was removed from the oven and allowed to cool to ambient temperature. The cable was then once again placed in the oven at 230° C. and while at this temperature the current was measured using a Hewlett Packard high resistance meter. The current measure was found to be 3.5 nanoamperes.

Next, a five hundred seventy-three foot length of cable was prepared in the same manner as in the above procedure, except that instead of shorting the cable, a 5.0 kv 60 cycle voltage was supplied to the cable for a period of eight hours and a temperature of 230° C. The voltage was maintained during cooling to room temperature. Again using the high resistance meter, the current was measured and found to be 5.0 nanoamperes. Measuring the cable charge without reheating to 230° C., a current of 5.8 nanoamperes was measured at room temperature. Taking into account the shorter length of cable, the equivalent for a seven hundred fifty foot length of cable so treated, would be 6.5 nanoamperes for a seven hundred fifty foot length. Thus, as compared with treatment using shorting instead of an AC voltage, pyro-electrically generated noise is approximately 87% greater for the latter as compared to the former.

The following observations may be derived from the above tests.

The pyroelectricity of a previously shorted cable measured at a reheat tempersature of 230° C. is at a level of 4.67 nanoamperes for a one thousand foot length as compared to a level of 8.73 nanoamperes for a thousand foot length generated from a cable to which a voltage was applied. The cable treated under the shorted conditions will not exhibit any substantial residual electric action at room temperature, whereas the construction described in the above mentioned prior patent will produce a current of 5.8 nanoamperes for a five hundred seventy-three foot length. Shorting of the dielectric during conditioning will therefore result in a marked reduction of room temperature discharges.

I wish it to be understood that I do not consider the invention limited to the precise details of structure shown and set forth in this specification, for obvious modifications will occur to those skilled in the art to which the invention pertains.

I claim:

1. The method of manufacturing a low noise electrical cable including at least one centrally disposed conductor, a dielectric sleeve and an outer conductive sheath which includes the steps of shorting the sheath to the conductor, and while maintaining the short, subjecting the cable to temperatures below the melting point of the dielectric and above any transition points for a period of time sufficient to completely change all crystalline structure of the material of the dielectric to amorphous state, and gradually reducing the temperature of the cable to room temperature.

* * * * *